US005261652A

United States Patent [19]

Kubo

[11] Patent Number: 5,261,652

[45] Date of Patent: Nov. 16, 1993

[54] SHEET FEED DEVICE FOR USE IN SHEET COUNTER

[75] Inventor: Shinichi Kubo, Tokyo, Japan

[73] Assignee: Musashi Engineering Kabushiki Kaisha, Tokyo, Japan

[21] Appl. No.: 969,404

[22] Filed: Oct. 30, 1992

[30] Foreign Application Priority Data

Apr. 13, 1992 [JP] Japan ..... 4-092672

[51] Int. Cl.[5] ..... B65H 3/06

[52] U.S. Cl. ..... 271/119; 271/121; 271/161

[58] Field of Search ..... 271/119, 161, 121, 122, 271/124, 125

[56] References Cited

U.S. PATENT DOCUMENTS 5,143,366 9/1992 Svyatsky ..... 271/161 X

FOREIGN PATENT DOCUMENTS 2908058 9/1979 Fed. Rep. of Germany ..... 271/119
59-153732 9/1984 Japan .
63-64194 3/1988 Japan .
63-282032 11/1988 Japan ..... 271/119

*Primary Examiner*—David H. Bollinger
*Attorney, Agent, or Firm*—Brooks Haidt Haffner & Delahunty

[57] ABSTRACT

A sheet feed device for use in a sheet counter arranged to separate stacked sheets one by one and to count the number of sheets. The sheet feed device has a feed roller having on its circumference a roller surface including a friction surface and a non-friction surface and a feed shaft, and at least one sheet separating member having a separation surface disposed so as to face the roller surface. Stacked sheets are separated one by one by the cooperation of the feed roller and the sheet separating member. The roller surface of the feed roller is formed so as to have a concave circular-arc sectional shape, and the separation surface of the sheet separating member is formed so as to have a convex circular-arc sectional shape. A gap is formed uniformly between the circular-arc surfaces formed in the roller surface and the separation surface, and the sheet separating member is disposed so that the uniform gap has a certain length along the circumferential direction of the feed roller.

4 Claims, 9 Drawing Sheets

SHEET FEED DEVICE FOR USE IN SHEET COUNTER

BACKGROUND OF THE INVENTION

1. Field of the Invention

This invention relates to a sheet feed device for use in a sheet counter and, more particularly, to an improvement in sheet transport/separation performance whereby damage to sheets is prevented.

2. Description of the Related Art

In general, sheet counters for counting the number of sheets of paper, such as bank notes, bills, slips, and labels (hereinafter referred to simply as sheets), have a construction in which a bunch of sheets are placed on a hopper, sheets are separated and transported therefrom one by one by a separation roller and a roller having a friction surface formed as a part of its circumferential surface, and the number of sheets is detected while the sheets are transported. The counted sheets are stacked in a certain sheet accommodation section (stacker).

In a sheet feed device of this kind of sheet counter, if the sheet feed device is arranged to prevent double-feed of sheets by the effect of friction, the differences between various frictional forces, such as (1) a frictional force produced between the feed roller and the sheet, (2) a frictional force produced between the sheets, and (3) a frictional force produced between the sheet and the separation roller, are utilized. To produce the differences of such forces, a sheet separating mechanism (a mechanism for preventing double-feed) is constructed so as to have a gap such that the force applied to two or more sheets passing therethrough is substantially large, while the force applied to one sheet is not so large.

This frictional force is produced by a method of applying a force to a small area or a method of applying a force to a thin linear portion with respect to a time point during the passage of each sheet.

For example, a technique for producing such a frictional force from a force applied to a very small area by the former method is disclosed in Japanese Patent Laid-Open Publication No. 59-153732. The technique disclosed in this publication relates to an arrangement using, as shown in FIGS. 1 and 2, a feed roller 5 having a friction surface A and a non-friction surface B formed in its circumferential surface and mounted through a feed shaft 10 so as to be driven with a motor, a take-in roller (guide roller) disposed in a front position above the feeding side of the feed roller 5 so as to be able to contact a sheet 9, and a separation roller 6 disposed at a rear position so as to face a recessed portion 8 of the feed roller 5 with a gap defined therebetween, through which only one sheet 9 can pass. The separation roller 6 and the take-in roller (guide roller) are linked by a gear. A one-way clutch is also provided to prevent the separation roller 6 from rotating in the sheet feeding direction when sheet 9 is introduced into the gap at the separation roller 6.

A technique for producing a frictional force from a force applied to a linear portion by the latter method is disclosed in Japanese Patent Laid-Open Publication No. 63-64194. The technique disclosed in this publication relates to an arrangement in which, as shown in FIGS. 3 and 4, a separation roller 6 is disposed so that its rotation shaft 11 is generally perpendicular to a feed shaft 10 of a feed roller 5 unlike the separation roller 6 in accordance with the former method, and is formed so as to have a predetermined axial length, and in which the separation roller 6 is opposed to a recessed portion 8 of the feed roller 5 generally perpendicularly, so that the amount of lapping of the separation roller 6 and the feed roller 5 is increased.

In the sheet separating mechanisms of the thus-constructed sheet feed devices, the frictional force for separating each sheet is proportional to the applied force, and therefore the same force may be applied to obtain the same sheet separating ability (i.e., the ability of preventing double-feed). Consequently, in the former and latter arrangements, the force applied per unit sheet area is very large if applied force/area is considered, and various problems described below are therefore encountered.

In the case of the former (Japanese Patent Laid-Open No. 59-153732), the shafts 10 and 11 for the feed roller 5 and the separation roller 6 are disposed parallel to each other so that the separation roller 6 is positioned in the rectangular recessed portion 8 of the feed roller 5. Also, in the lapping relationship between a separation surface 7 on the circumference of the separation roller 6 and a roller surface 4 on the circumference of the feed roller 5, a point of contact between the feed roller 5, the separation roller 6 and the sheet 9 at a certain time point is virtually a geometrical point and the amount of lapping of the feed roller 5 and the separation roller 6 is small, so that the force of pressing the sheet 9 by the separation roller 6 at the time of sheet separation is very large. In other words, a pressing force is applied to the sheet 9 by the contact with edges 8*a* of the recessed portion 8 of the feed roller 5 and with edges 7*a* of the separation surface 7 of the separation roller 6, as indicated by the arrows in FIG. 2. The sheet receives a particularly concentrated load from the edges 7*a* of the separation roller 6.

There is therefore a problem in that the pressing force from the edge 7*a* of the separation roller 6 contacting the sheet 9 generally perpendicularly can easily cause an impression of creasing of the sheet in a direction corresponding to the direction in which the sheet is transported (a crease line or an elongated recess having the same width as the roller ) if the sheet is new. If sheets in which such a crease line is formed are counted again by being reversed, the crease line is reversely changed into a line of protrusion, that is, the creased portion of the sheet is flapped by the separation roller 6 at the entrance of the sheet separating mechanism, so that the end of the creased portion of the sheet is ripped. Thus, there is a second problem of such a further damage to the sheet.

If there is an ink or a pencil material of a print or letters on the sheet, the separation roller 6 contacts this material to cause flowing of the print or the letters, thereby seriously contaminating the sheet surface. Further, the image on the sheet may be transferred to the separation surface 7 of the separation roller 6 and may be transferred again to the surface of another sheet, resulting in the formation of a thick stripe corresponding to the thickness of the separation surface 7 of the separation roller 6 on the sheet surface. There is a third problem of the appearance of the sheet being impaired in this manner.

The separation surface 7 of the separation roller 6 acts to impose a large load upon the sheet 9, as mentioned above. There is therefore a fourth problem of the edge portions 7a being easily worn unevenly, although they are rotated to avoid unevern wear.

Further, if sheets once creased, relating to the above-described problem, i.e., sheets curved along the shape of the separation roller 6 at the sheet separating mechanism or repeatedly counted sheets, are introduced, it is possible that the shape of the separating portion of the sheet separating mechanism will coincide with the curved shape of such sheets, and the sheets can pass through the mechanism without being separated in such a situation, that is, can be transported in a superposed state.

On the other hand, in the sheet separating mechanism of the latter type of arrangement (Japanese Patent Laid-Open No. 63-64194), the separation roller 6 has a roller shape with the roller separation surface 7 facing the rectangular recess 8 of the feed roller 5. In the lapping relationship between the separation surface 7 on the circumference of the separation roller 6 and roller surface 4 on the circumference of the feed roller 5, a point of contact between the feed roller 5, the separation roller 6 and the sheet 9 at a certain time point is included in a line of contact. Therefore, the amount of lapping of the feed roller 5a and the separation roller 6 is a largely increased in comparison with the former arrangement, so that the sheet 9 separating ability is improved and unevern wear of the separation surface 7 can be prevented by rotating the separation roller 6. Thus, improvements with respect to the above-mentioned fourth and fifth problems of the point-contact sheet separation can be achieved.

In this arrangement, however, a considerably large pressing force is applied to the sheet 9 at positions where the sheet 9 faces the edges 8a of the rectangular recessed portion 8 the feed roller 5, as indicated by the arrows in FIG. 4, since the separation roller 6 is arranged to separate sheets by line-contact based on being positioned in the recessed portion 8 of the feed roller 5, although the separation roller 6 has a circular-arc surface capable of entering the recess B. Consequently, the above-mentioned first to third problems of the former arrangement (crease, ripping, contamination and so on) are still left although small improvements with respect to these problems have been achieved.

SUMMARY OF THE INVENTION

In view of these problems an object of the present invention is to provide a sheet feed device for a sheet counter in which the area of contact between a sheet separating member and each of sheets to be counted is increased to improve the sheet separating performance while the sheet is prevented from being damaged.

According to the present invention, there is provided a sheet feed device for use in a sheet counter including a feed roller having on its circumference a roller surface including a friction surface and a non-friction surface and a feed shaft, and at least one sheet separating member having a separation surface disposed so as to face the roller surface, stacked sheets being separated one by one by the cooperation of the feed roller and the sheet separating member. A surface having a concave circular-arc sectional shape is formed in roller surface of the feed roller, while a surface having a convex circular-arc sectional shape is formed in the separation surface of the sheet separating member disposed so as to face the roller surface. A gap is formed uniformly between the circular-arc surfaces formed in the roller surface and the separation surface, and the sheet separating member is disposed so that the uniform gap has a certain length along the circumferential direction of the feed roller.

More specifically, the sheet separating member is swingably supported axially and is urged toward the feed roller by a spring means, so that the sheet separating member can be independently operated to adjust the gap between the sheet separating member and the feed roller.

In the sheet feed device for a sheet counter in accordance with the present invention, the circular-arc surfaces having a concave cross section and formed in the roller surface of the feed roller and the circular-arc surface having a convex cross section and formed in the separation surface of the sheet separating member are spaced apart from each other to an extent such that one sheet can pass therethrough. The gap thereby defined is formed uniformly through the whole circumference of the opposed circular-arc surface, and this uniform gap is formed so as to have a certain length along the circumferential direction of the feed roller. Sheets are separated by the cooperation of the circular-arc roller surface and the circular arc. The feed roller and the sheet separating member can contact each other in a surface-contact manner, so that an increased area of contact is achieved. It is thereby possible to markedly reduce the contact pressure per unit area while the same separating force is obtained. The sheet transport/separation performance can therefore be improved. Also, the extent of wear of the sheet separating member can be reduced and the sheet can be prevented from being damaged.

DESCRIPTION OF THE PREFERRED EMBODIMENT

Figure 1:
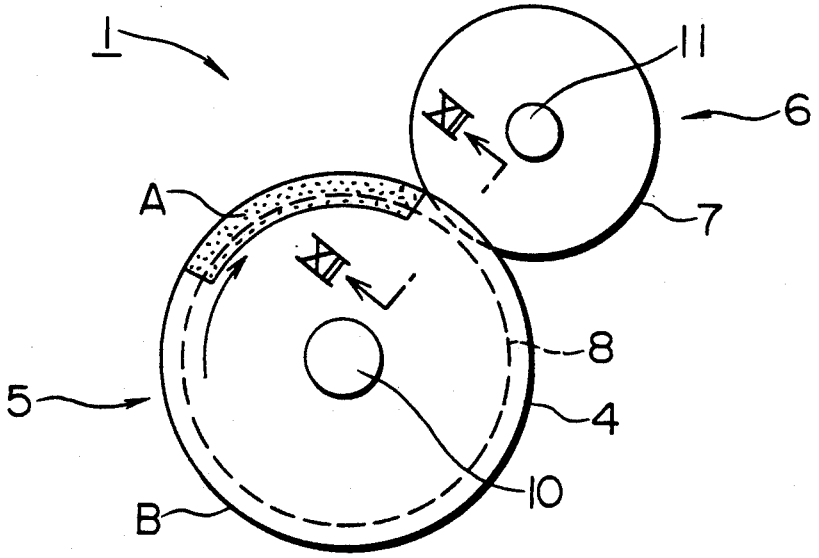
FIG. 1 (PRIOR ART)
FIG. 1 is a side view of an essential portion of a conventional sheet feed device.

A sheet feed device for use in a sheet counter in accordance with a preferred embodiment of the present invention will be described below in detail with reference to the accompanying drawings.

Components of this embodiment identical or corresponding to those of the conventional arrangement are indicated by the same reference characters.

Figure 5:
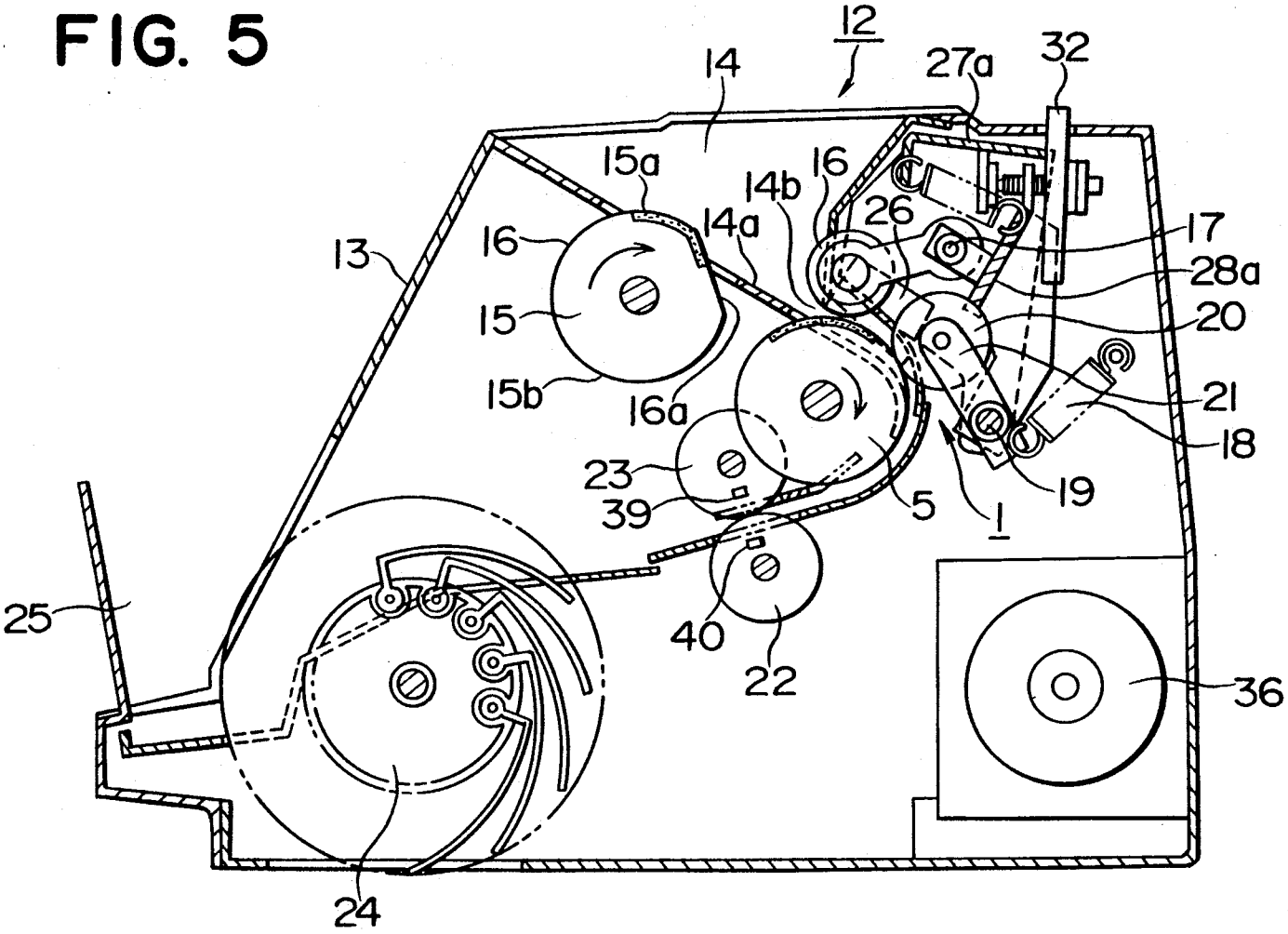
FIG. 5 is a schematic cross-sectional view of the construction of a sheet counter in accordance with the present invention.

Referring to FIG. 5, a unit 12 is a sheet counter which separates and transports stacked sheets one by one to count the number of sheets. The sheet counter 12 is housed in a case 13 and has a hopper 14 formed at its top. Sheets are stacked in the hopper 14. A pair of auxiliary feed rollers 15 are disposed under the hopper 14 so as to be able to project and retract through a bottom plate 14*a*. The auxiliary feed rollers 15 serve to transport the lowermost one of the stacked sheets to a sheet feed device 1 described later. A surface 16 of each auxiliary feed roller 15 is formed of a friction surface 15*a* and a non-friction surface 15*b*, and the friction surface 15*a* extends as to form a part of a cut surface 16*a*.

A pair of left and right guide rollers 16 are disposed in the vicinity of a sheet outlet 14*b* of the hopper 14 so as to face a central portion of the same. The pair of guide rollers 16 are swingable on a support point 17, and are maintained in contact with a feed roller 5 described later by their weight. A pinch roller 20 urged against the feed roller 5 by a spring means is disposed on the downstream side of the guide rollers 16. The pinch roller 20 is urged against a second feed roller 5*b* described later rotatably supported on end portions of an operating arm member 21 which is, in turn, swingably supported on a rotation shaft 19 supported on side walls of the case 13.

A pair of left and right draw-out rollers 22 and 23 are disposed in upper and lower positions downstream of the feed roller 5 to forcibly draw out each sheet from the feed roller 5. Further, a pair of left and right blade wheels 24 is rotatably disposed downstream of the rollers 22 and 23. The blade wheels 24 are capable of receiving transported sheets between its blades in such a manner that each sheet is introduced between one of adjacent pairs of the blades. Sheets separated one after another by the blade wheels 24 are accumulated on a stacker 25. A transmisssion-type sensor elements 39 and 40 are provided in the vicinity of the draw-out rollers 22 and 23 so as to face this sheet path. These sensor elements serve to detect the occurrence of double-feed, chaining and the like of transported sheets and also serve to count the number of sheets.

Figure 6:
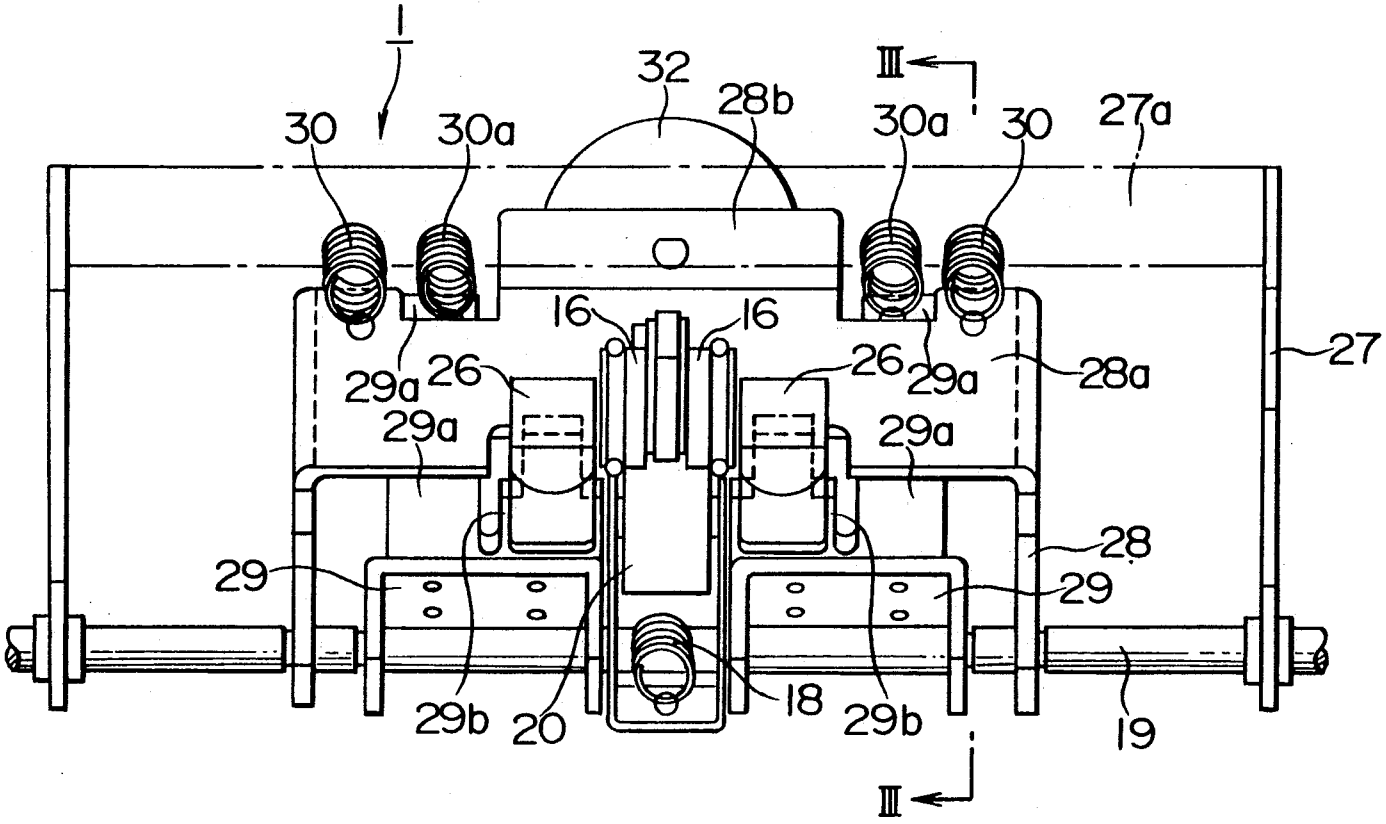
FIG. 6 is a front view of a sheet feed device for the sheet counter in accordance with the present invention.
Figure 7:
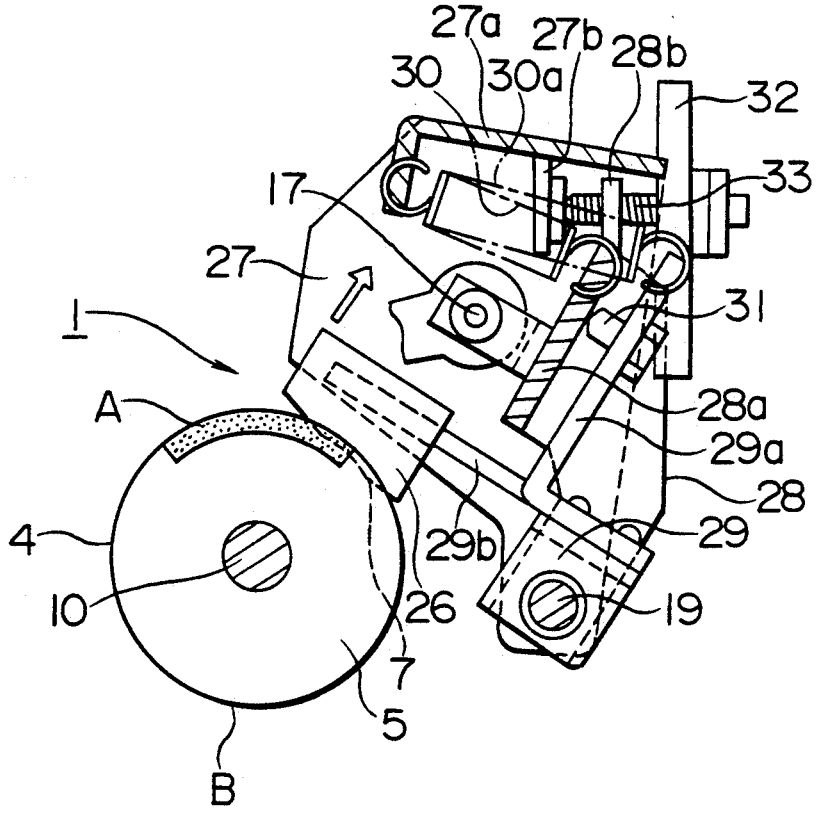
FIG. 7 is a cross-sectional view taken along the line III—III of FIG. 6.

The sheet feed device 1 having a construction such as that shown in FIGS. 6 and 7 is disposed at a transport path on the downstream side of the hopper 14 and between the auxiliary feed rollers 15 and the draw-out rollers 22 and 23. The feed roller 5 rotatable on a feed shaft 10 is disposed under the sheet feed device 1. Stationary sheet separating members 26 are disposed above the feed roller 5, and a separation surface 7 of each sheet separating member 26 is formed so as to face a roller surface 4 of the feed roller, thererby constituting a sheet separation mechanism.

The sheet feed device 1 is provided with a first support member 27 having a first support 27*a* extending parallel to the rotation shaft 19. The first support member 27 is rotatably attached to the rotation shaft 19. A second support member 28 havng a second support 28*a* extending parallel to the rotation shaft 19 is provided inside the first support member 27. The first support member 28 is rotatably attached to the rotation shaft 19, and is urged toward the first support 27*a* by tensile springs 30. The guide rollers 16 are attached to the second support 28*a* through a support shaft 17. The second support 28*a* has a raised extension 28*b* formed at its top. The raised extension 28*b* has a desired inclination angle.

A pair of left and right third generally-U-shaped support members 29 are provided inside the second support member 28. Each third support member 29 has a third support 29*a* formed as its upper portion at the rear of the second support 28*a* and extending vertically. The third support members 29 are rotatably attached to the rotation shaft 19, and tensile springs 30*a* stretched between the third supports 29*a* and the first support 27*a* apply a tensile force to the third supporst 29*a* so that the third supports 29*a* can be brought closer to the first support member 27.

An adjustment screw 31 projecting toward the second support 28*a* is provided on each third support 29*a*. The adjustment screw 31 is urged toward the second support 28*a* by the tensile spring 30*a*. A support rod 29*b* extending in a direction perpendicular to the direction along the third suppport 29*a* is provided integrally on each third support member 29. The sheet separating members 26 are attached to the support rods 29*b* so as to be able to project and retract.

A dial member 32 for adjusting the gaps between the sheet separating member 26 and the roller surface 4 of the feed roller 5 is provided on sheet feed device 1. A threaded member 33 having an and to be brought into abutment against a raised extension 27*b* formed of the first support 27*a* is provided on the dial member 32. The threaded member 33 is screwed through the above-mentioned extension 28*b*. The raised portion 28*b* is translated along the threaded member 33 by the rotation of the dial member 32. The second support 28*a* is moved in accordance with the extend of this translation and the raised extension 28*b*, and the third support 29*a* rotates by following this movement through the adjustment screw 31. By this rotation, the support rods 29*b* fixed on the third support members 29 are rotated on the rotation shaft 19 to increase or reduce the gaps between the separation surfaces 7 of the sheet separating members 26 and the roller surface 4 of the feed roller 5.

In this arrangement, since the third support member 29 is indirectly urged forward of the first support member 27 by the tensile springs 30*a* through the operation of the second support member 28, and since also the second support member 28 is indirectly ward of the first support member 27 by the tensile springs 30, the operation of the third support member 29 is normally limited and the third support member 29 is independently suspended so as to be able to move alone if necessary. If the gaps between the separation surface 7 of the sheet separating members 26 and the roller surface 4 of the feed roller 5 cannot be even through a predetermined length at lapping portions described later by some reason when the separation surfaces 7 face the roller surface 4, if one of the sheet separating member 26 is worn faster, or if a situation necessitating the gap adjustment occurs, for example, at the time of interchange of the sheet separating members 26, the adjustment screw 31 corresponding to one of the sheet separating members to be moved may be independently rotated to adjust only the corresponding gap to the even value without operating the dial 32.

Figure 8:
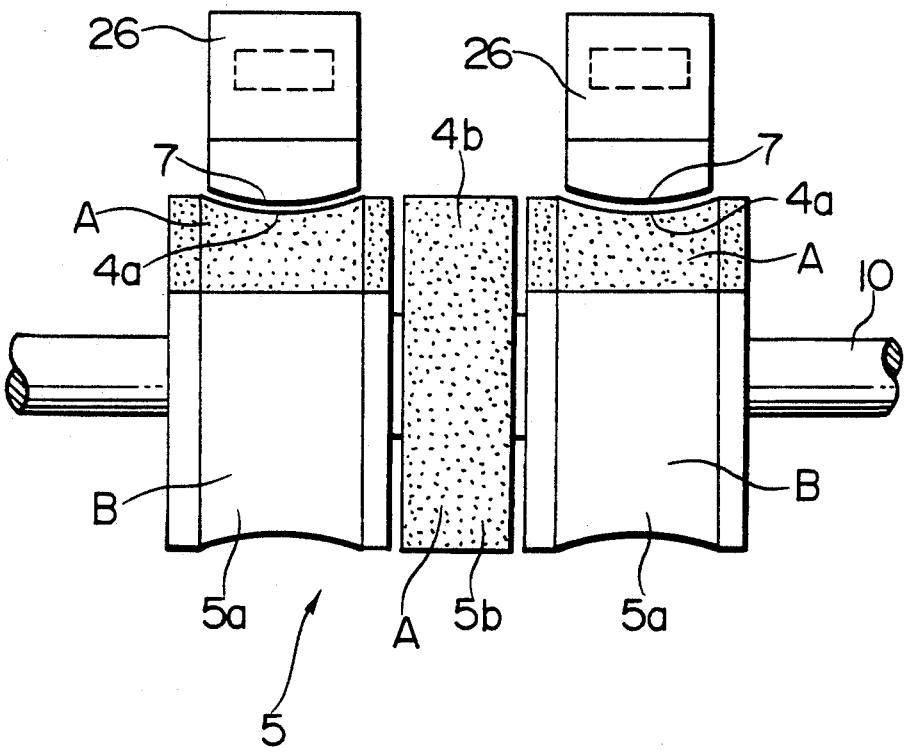
FIG. 8 is a front view of an essential portion of the sheet feed device.

The relationship between the feed roller 5 and the sheet separating members 26 will be described below in detail. As shown in FIG. 8, the feed roller 5 is constituted of the above-mentioned second feed roller 5*b* disposed in a central position and attached to the feed shaft 10 through a one-way clutch disposed inside, and a pair of first feed rollers 5a disposed on the opposite sides of the roller 5b and fixed to the feed shaft 10. A second roller surface 4b of the second feed roller 5b is formed as a friction surface A through the whole circumference thereof, while a first roller surface 4a of each first feed roller 5a is formed of a friction surface A and a non-friction surface B. The first roller surface 4a of each first feed roller 4a is formed so as to have a concave circular-arc sectional shape through the whole circumference. The separation surfaces 7 of the sheet separating members 26 have a convex circular-arc sectional shape and are placed so that the circular-arc surface having a convex cross section and the circular-arc surface. having a concave cross section face each other with a spacing defined therebetween in correspondence with the thickness of each of sheets 9 to be counted (see FIGS. 9 and 10).

Figure 2:
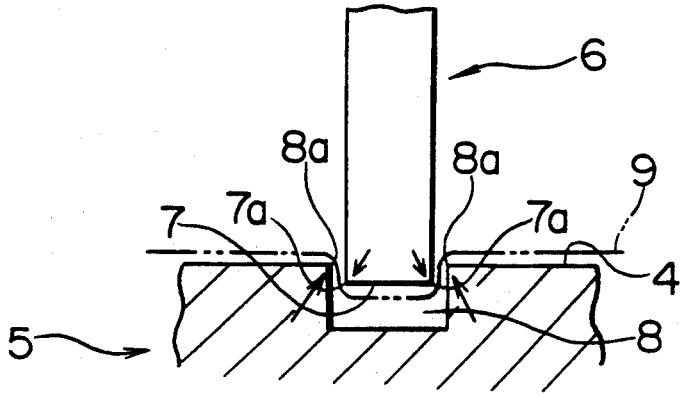
FIG. 2 (PRIOR ART)
FIG. 2 is an enlarged cross-sectional view taken along the line XII—XII of FIG. 1.
Figure 3:
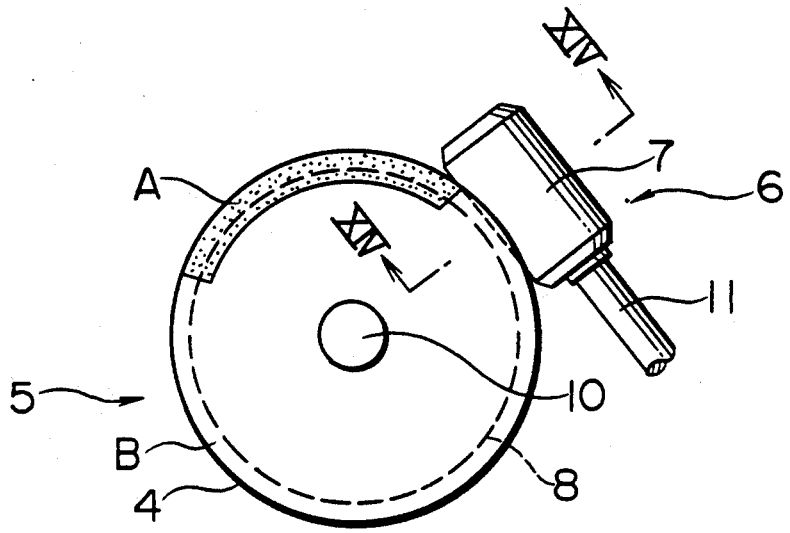
FIG. 3 (PRIOR ART)
FIG. 3 is a side view of an essential portion of another conventional sheet feed device.
Figure 4:
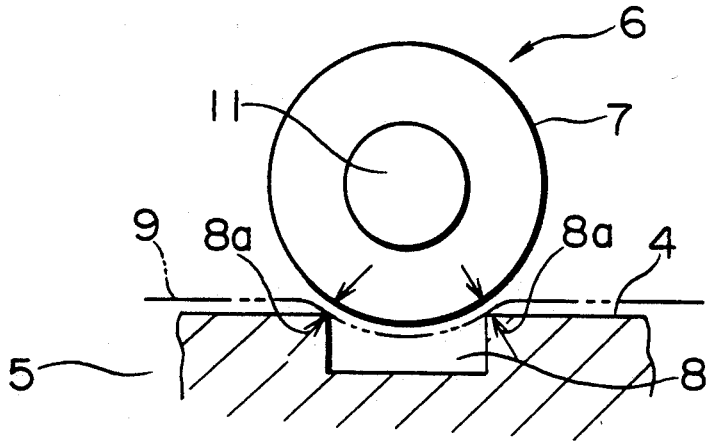
FIG. 4 (PRIOR ART)
FIG. 4 is an enlarged cross-sectional view taken along the line XIV—XIV of FIG. 3.
Figure 9:
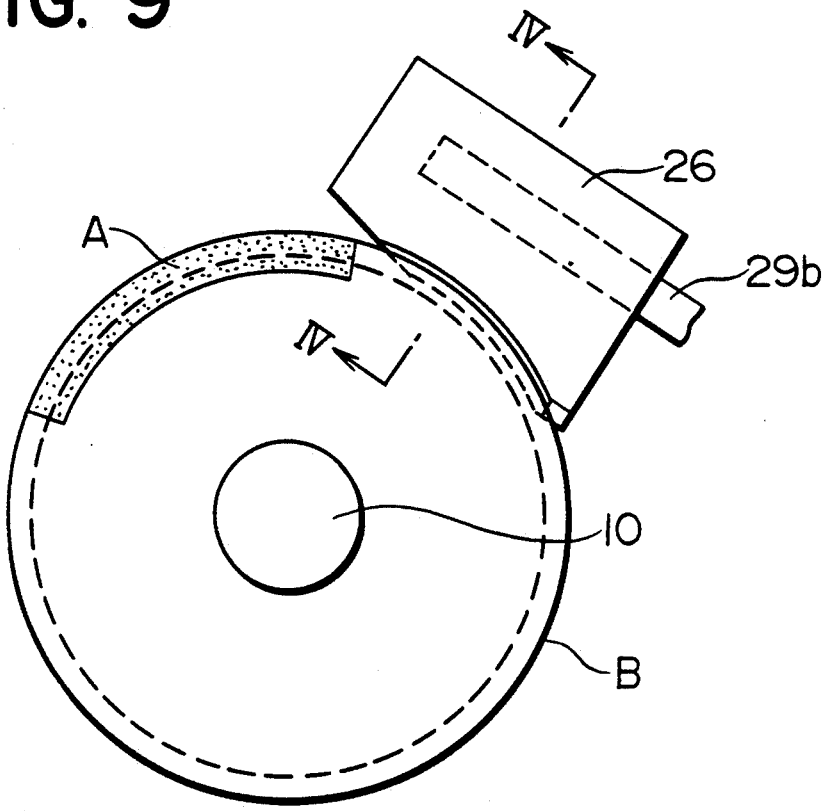
FIG. 9 is an enlarged side view of FIG. 8.
Figure 10:
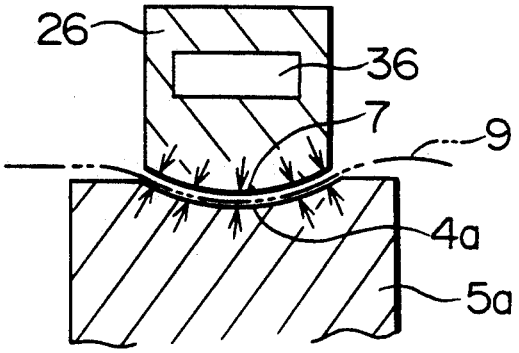
FIG. 10 is a cross-sectional view taken along the line IV—IV of FIG. 9.
Figure 11:
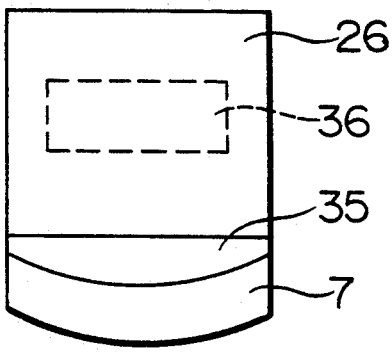
FIG. 11 is a front view of a sheet separating member.
Figure 12:
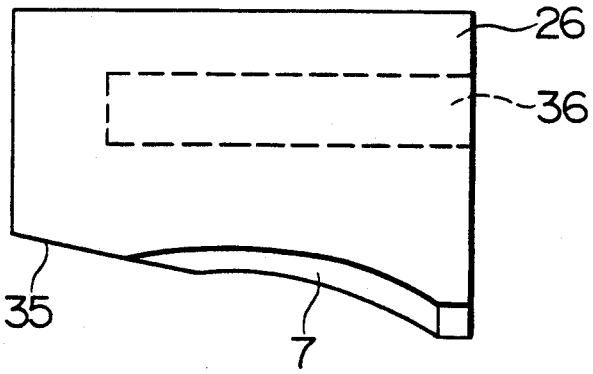
FIG. 12 is a side view of the sheet separating member.
Figure 13:
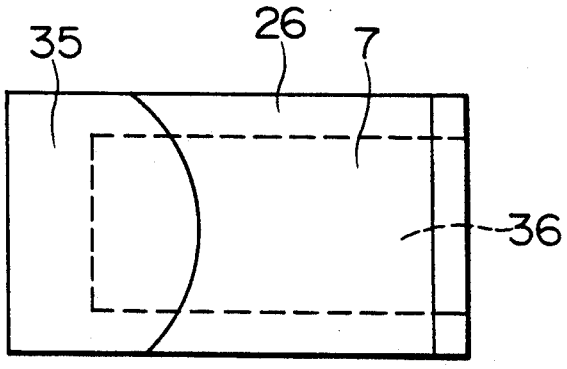
FIG. 13 is a bottom view of the sheet separating member.
Figure 14:
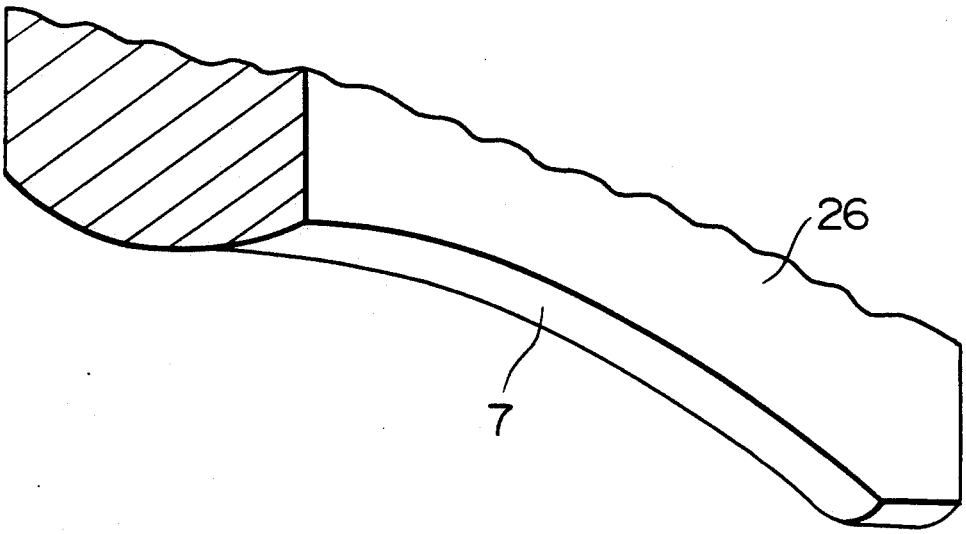
FIG. 14 is a perspective view of an essential portion of the sheet separating member.

Each sheet separating member 26 is formed in such a manner that, as shown in FIGS. 11 to 14, its thickness is greater than that of the conventional separation roller 6, a guide surface 35 is provided at the fore end of a bottom portion, and a separation surface 7 of a predetermined length having a convex circular-arc sectional shape and a three-demensionally curved shape is formed between the guide surface 35 and the rear end so as to face the first roller surface 4a of the first feed roller 5a having a concave circular-arc cross section while being uniformly spaced from this roller surface. Accordingly the gap formed between the first roller surface 4a and the separation surface 7 has a curved shape such as to be uniform as viewed in the cross-sectional direction, as shown in FIG. 8, and is also uniform through the predetermined length of the lapping portions of the first roller surface 4a and the separation surface 7 along the circumferential direction of the roller, as shown in FIG. 9, so that the area of the facing portions of the feed roller 5 and the sheet separation members 26 is substantially large. In this embodiment, the thickness of the sheet separating members 26 is thrice as large as the thickness of the conventional separation roller 6 (see FIGS. 1 and 2), but this not exclusive. The thickness of the sheet separating member 26 may be selected as desired according to need.

The operation of the sheet counter will be described below with respect to the above-described construction.

A number of sheets to be counted are first stacked in the hopper 14. The dial member 32 is then rotated to adjust the gaps between the first roller surfaces 4a of the first feed rollers 5a and the separation surfaces 7 of the sheet separating members 26 to a value approximately equal to the thickness of one sheet. Thereafter, driving of a motor 36 (see FIG. 5) is started by turning on a switch (not shown) to rotate the auxiliary feed rollers 15, the feed roller 5, and the draw-out rollers 22 and 23. Simultaneously, an unillustrated motor is driven to rotate the blade wheels 24 under certain control conditions. One of the stacked sheet at the lowermost position is fed toward the feed roller 5 by the friction surfaces 15a of the auxiliary feed rollers 15.

At this time, the sheet is fed to the gaps between the facing portions of the first feed rollers 5a and the sheet separating members 26 whose area is increased by the effect of the arrangement in which the gaps are uniformly formed by the surface of the sheet separating member 26 having a convex circular-arc cross-sectional shape and the surfaces of the first feed rollers 5a having a concave circular-arc cross-sectional shape, and in which the gaps are also uniform through the predetemined length of the separation surfaces 7 of the sheet separating members 26. That is, the sheet contacts the sheet separating members 26 by an increased area for an increased contact time (sheet separation time). In this state, the sheet is separated by the effect of setting and maintaining a tensile force applied to the sheet from the feed roller 5 which force is greater than a pressing force (frictional force) of the sheet separating members 26.

In this embodiment, therefore, the sheet contacts the feed roller 5 and the sheet separating members 26 in a surface contact manner at a certain time point, while in the conventional sheet feeder (FIGS. 1 to 4) the corresponding members contact each other in a point- or line-contact manner. Consequently, the force of the sheet separating members 26 pressing the sheet (contact pressure) is uniformly dispersed in the circular-arc gap as indicated by the arrows in FIG. 10, and the contact pressure per unit area can be markedly reduced while the same separating force is obtained.

The relationships between the frictional forces of the sheet separating members 16, the feed roller 5 and the sheet at the large-area gap are as described below. Assuming that (1) the frictional force between sheet and the friction surfaces A of the first feed rollers 5a is $F_1$,
(2) the frictional force between the sheet and the sheet separating members 26 is $F_2$,
(3) the frictional force between the sheets is $F_3$,
(4) the frictional force between the sheet and the non-friction surfaces B of the first feed rollers 5a is $F_4$, and that $F_1>F_2$, $F_2>F_3$ and $F_2>F_4$, an inequality: $F_1>F_2>F_3$ is established, so that the sheet separation is effected by the effect of the differences between the frictional forces.

Therefore, if the sheet laid on the lowermost sheet in the holder is simultaneously transported to the gap in a state of being superposed on the lowermost sheet, the upper sheet is stopped and maintained in a waiting state at the ends (inlet portions) of the separation surfaces 7 of the sheet separating members 26 in accordance with the above-mentioned force relationship $F_2>F_3$, while the lower sheet is fed forward with the rotation of the friction surfaces A of the first feed rollers 5a in accordance with the above-mentioned force relationship $F_1>F_2$. During this operation, while the lower sheet is transported by being moved forward, the upper sheet is brought into contact with the non-friction surfaces B of the first feed rollers 5a with the transition from the force relationship $F_2$ to $F_3$ to the force relationship $F_2>F_4$, so that the waiting state of the upper sheet is maintained until the first feed rollers 5a make one revolution. When the upper sheet is thereafter brought into contact with the frictional surfaces A, the corresponding force relationship is changed from $F_2$ to $F_4$ to $F_1>F_2$ again, and the sheet is fed forward by the rotation of the first feed rollers 5a and simultaneously separated from the next sheet in the waiting state.

Further, if two sheets in a superposed state are simultaneously introduced into the gap although they have undergone the sheet separation at the inlet of the gap, the lower sheet is fed forward with the rotation of the friction surfaces A of the first feed rollers 5a based on the relationships between the frictional forces of the sheet separating members 26, the feed roller 5 and the sheets in this case, i.e., $F_1>F_2>F_3$, and, when the upper and lower sheets are released from the superposed state by the forward movement of the lower sheet, the upper sheet is brought into contact with the non-friction surfaces B of the first feed rollers 5a rotated continuously so that the force relationship $F_2 > F_4$ is established along with the force relationship $F_2 > F_3$. The upper sheet is therefore maintained in the gap in a waiting state at a position on the separation surfaces 7 of the sheet separating members 26. When the first feed rollers 5a make one revolution so that the friction surfaces A appears again to contact the upper sheet, the corresponding force relationship is changed from $F_2$ to $F_4$ to $F_1 > F_2$ again, and the sheet is fed forward from the waiting position in the gap.

The cases in which two sheets are transported in a superposed state have been described. Even if three or more sheets are superposed, the gap is formed always uniformly and a sufficiently long time for contact between the sheet and the sheet separating members 26 can be obtained within the range of the predetermined length of the separation surfaces 7 of the sheet separating members 26. Therefore, the sheets can be separated in the same manner as long as the upper sheets introduced into the gap simultaneously with the lower sheet are retained in a waiting state in the gap, and the separated sheets are successively transported to the downstream side.

When the leading end of each separated sheet reaches the position of the pinch roller 20 with the rotation of the friction surfaces A of the first feed rollers 5a, the sheet is pinched between the friction surface A of the second feed roller 5b and the pinch roller 20 to be continuously fed forward. When a trailing half of the sheet reaches the position to contact the non-friction surfaces B of the first feed rollers 5a, i.e., the smooth surfaces, the leading end of the sheet passes through the transport path formed by guide members and is pinched between draw-out rollers 22 and 23 rotating at a constant speed slightly higher than the peripheral speed of the first feed rollers 5a, so that the sheet is forcibly drawn out by the draw-out rollers 22 and 23.

Therefore, the speed of the sheet at which the sheet passes the transmission type sensor elements 39 and 40 is not influenced by the peripheral speed of the first feed rollers 5a, that is, the sheet can be transported at a constant speed approximately equal to the peripheral speed of the draw-out rollers 22 and 23 because the second feed roller 5b has no braking effect. Sheets pass the transmission type sensor elements 39 and 40 at a constant speed, and the number of sheets can therefore be counted with accuracy. Having passed through the nip between the draw-out rollers, sheets are separately pinched one by one between the blades of the blade wheels 24 and are then changed in attitude to be stored in the stacker 25.

It is possible that if the stacked state of sheets in the hopper 14 is, for example, such that a certain number of newly stacked sheets in a sticking state cannot be separated, sheets are sticking together very tightly, or sheets are fastened together by an adhesive material, or if a large number of sheets are introduced by a certain state of stacking so that the relationship represented by the above-described inequalities of the frictional forces between the relating members cannot be established. In such a situation, the sheet separating members 26 are forcibly moved in the direction of the arrow in FIG. 7 to an extent corresponding to the thickness of sticking sheets by the rotation on the shaft 19 against the urging force of the tensile springs 30a, and the sheets are fed together in the sticking state with the rotation of the first, feed rollers 5a to pass through the sheet separating mechanism without causing clogging.

When the group of sheets causing this transportation abnormality passes the transmission type sensor elements 39 and 40 the abnormality state is detected and the unillustrated clutch for driving connection between the feed roller 5 and the motor 36, a brake and other members are operated based on an output of this detection to stop the rotation of the feed roller 5 and the auxiliary feed rollers 15. The rotation of the blade wheels 24 is stopped by stopping the driving of the unillustrated motor after a predetermined time elapsed after the time the superposed sheets have been stored in the stacker 25 through the blade wheels 24. Thereafter, all the sheets stored in the stacker 25 are stacked in the hopper 14 again and the start switch is operated to newly start the counting operation.

The sheet feed device for the sheet counter in accordance with the present invention is arranged as described above and has advantages described below.

The sheet feed device of the present invention is arranged in such a manner that roller surfaces of a feed roller are formed so as to have a concave circular-arc sectional shape, and separation surfaces of sheet separating members disposed so as to face the roller surfaces are formed so as to have a convex circular-arc sectional shape, so that sheets are separated by the cooperation of the circular-arc roller surfaces and separation surfaces. A gap having a curved cross-sectional configuration is thereby formed uniformly through the whole circumferential range of the circular-arc surfaces of the feed roller and the sheet separating members facing each other, and the gap is also formed uniformly in the circumferential direction of the roller through the predetermined length of the overlapping portions. An increased area of contact between the sheet separating members and the sheet is thereby achieved, and sheets can be separated in a surface-contact manner in contrast with the conventional point-contact or line-contact separation. Also, the time for contact between the sheet and the sheet separating members is increased. It is thus possible to improve the sheet separating ability.

Also, frictional forces can be obtained with respect to a large area by facing between the circular-arc surfaces of the feed roller and the sheet separating members, so that the sheet pressing force (contact pressure) can be dispersed uniformly through the circular-arc surfaces of these members without concentration of the force to a particular portion caused in the case of the conventional sheet feed device. It is thereby possible to minimize the force applied per sheet unit area for obtaining the same sheet separating ability, i.e, the applied force/area.

Consequently, all the problems of the conventional sheet feed device which have been difficult to solve, i.e., the problem of formation of a crease line in the sheet surface caused by the roller member (first problem), the problem of occurrence of a rip in the creased sheet surface at the time of reversing (second problem) and the problem of contamination of the sheet surface due to flowing or transfer of characters or the like formed on the sheet surface (third problem), can be solved.

Moreover, the force applied to each sheet is made uniform by the above-described arrangement, so that a smaller force of pressing the sheet will suffice, and so that progress of wear of the sheet separating members is therefore very slow in comparison with the conventional device and the extent of wear can be markedly reduced. In particular, the problem of uneven wear of the conventional fixed type sheet separating member can be solved.

What is claimed is:

1. A sheet feed device for use in a sheet counter comprising in combination:

a feed roller mounted on a feed shaft and having on its circumference a roller surface including a friction region, a non-friction region, and an annular surface region having a concave circular-arc cross-sectional shape; and at least one non-rotatable sheet separating member having a separation surface and disposed with said separation surface facing said feed roller surface in line with said concave cross-sectional shape surface region of said feed roller spaced therefrom by a predetermined gap, said separation surface having a cross-sectional shape in the form of a convex circular arc complementing said concave circular-arc shape and having a longitudinal shape that is arcuate for a predetermined distance substantially concentric with said feed roller annular surface;

whereby stacked sheets are separated one by one by the cooperation of said feed roller and said sheet separating member.

2. A sheet feed device according to claim 1, wherein said sheet separating member is mounted for movement toward and away from said feed roller for changing said predetermined gap.

3. A sheet feed device according to claim 2, wherein means are coupled to said sheet separating member elastically biasing said sheet separating member for movement toward said elastically biased movement of said sheet separating member at a position for establishing said predetermined gap whereby said sheet separating member will yield when confronted with an excessive misfeed.

4. A sheet feed device according to claim 2, wherein a spring member is coupled to said sheet separating member for urging said separating member toward said feed roller.

* * * * *

UNITED STATES PATENT AND TRADEMARK OFFICE

CERTIFICATE OF CORRECTION

PATENT NO. : 5,261,652

DATED : November 16, 1993

INVENTOR(S) : S. Kubo

It is certified that error appears in the above-indentified patent and that said Letters Patent is hereby corrected as shown below:

Column 3, line 36, after "8" insert --of--.

Column 6, line 26, "and" should read --end--; line 45, after "indirectly" delete "ward", insert --urged forward--.

Column 10, line 1, after "first" delete comma ",".

Column 12, line 13, after "said" insert --feed roller, and adjustable means are disposed for stopping said--.

Signed and Sealed this

Fourteenth Day of June, 1994

Bruce Lehman

*Attest:*

BRUCE LEHMAN

*Attesting Officer*

*Commissioner of Patents and Trademarks*